US007472841B2

(12) United States Patent
Erhard et al.

(10) Patent No.: US 7,472,841 B2
(45) Date of Patent: Jan. 6, 2009

(54) SPRAY HEAD FOR A SPRAYING TOOL

(75) Inventors: Norbert Erhard, Lorch (DE); Hubert Pschenitschni, Winterbach (DE)

(73) Assignee: Oskar Frech GmbH + Co. KG, Schorndorf (DE)

( * ) Notice: Subject to any disclaimer, the term of this patent is extended or adjusted under 35 U.S.C. 154(b) by 599 days.

(21) Appl. No.: 10/825,332

(22) Filed: Apr. 16, 2004

(65) Prior Publication Data

US 2004/0217211 A1 Nov. 4, 2004

(30) Foreign Application Priority Data

Apr. 19, 2003 (EP) ..... 03009080

(51) Int. Cl.
*A62C 31/02* (2006.01)

(52) U.S. Cl. ..... 239/390; 239/549; 239/397; 239/412; 285/124.5

(58) Field of Classification Search ..... 239/267, 239/397, 412, 266, 268, 390, 536, 554, 555, 239/556, 560, 562, 566, 600, 442, 444, 5, 239/549; 285/137 R, 124.5; 269/138
See application file for complete search history.

(56) References Cited

U.S. PATENT DOCUMENTS

| | | | | | |
|---|---|---|---|---|---|
| 3,341,124 | A * | 9/1967 | Barnes | 239/8 |
| 4,082,324 | A * | 4/1978 | Obrecht | 285/124.5 |
| 4,306,587 | A * | 12/1981 | Tchebinyayeff | 137/606 |
| 4,605,170 | A * | 8/1986 | Thurner | 239/444 |
| 4,739,933 | A * | 4/1988 | Hanano | 239/304 |
| 4,760,961 | A * | 8/1988 | Nagai | 239/267 |
| 4,774,109 | A * | 9/1988 | Hadzimihalis et al. | 427/286 |
| 5,518,043 | A * | 5/1996 | Cheung et al. | 140/93.2 |
| 5,725,255 | A * | 3/1998 | Hayashi et al. | 285/26 |
| 5,916,367 | A * | 6/1999 | Wollin | 118/306 |
| 5,944,056 | A * | 8/1999 | Miyazoe et al. | 137/625.64 |
| 5,967,418 | A * | 10/1999 | MacDonald et al. | 239/391 |
| 6,269,823 | B1 * | 8/2001 | Lincoln | 134/131 |
| 6,422,428 | B1 * | 7/2002 | Allen et al. | 222/318 |
| 6,722,587 | B2 * | 4/2004 | Hanano | 239/548 |
| 6,742,729 | B2 * | 6/2004 | Lin | 239/590 |
| 2004/0222322 | A1 * | 11/2004 | Erhard et al. | 239/549 |

FOREIGN PATENT DOCUMENTS

| | | |
|---|---|---|
| DE | 199 41 820 C 1 | 2/2001 |
| EP | 0 125 149 A1 | 11/1984 |
| EP | 0 724 486 B1 | 10/1994 |

* cited by examiner

*Primary Examiner*—Len Tran
*Assistant Examiner*—Trevor E. McGraw
(74) *Attorney, Agent, or Firm*—Crowell & Moring LLP

(57) ABSTRACT

A spray head is described for spraying the molds in pressure casting machines, and in it spray nozzles are mounted on bars equipped with supply passages, which form units which can be placed together. To fit these bar units together, coupling elements in the form of cylindrical pins provided with passages are provided, which are provided with recesses having sloping planes which are engaged by the conical tips of Allen screws and thus produce a clamping together of adjacent bar units. The coupling elements are provided at both end faces with sealing rings and their bore aligns with the passages in the bars. Through the use of angle pieces media supply bars bearing spray nozzles can be joined together at any angle to one another.

9 Claims, 2 Drawing Sheets

1
2
3
4
5
6
7
8
9
10
11
12
13
14
15
16
16a
20
II 12
16
16a
17
18
19
20
III

SPRAY HEAD FOR A SPRAYING TOOL

This application claims the priority of European Patent Application No. 03009080.7, filed Apr. 19, 2003, the disclosure of which is expressly incorporated by reference herein.

BACKGROUND AND SUMMARY OF THE INVENTION

The invention relates to a spray head for a spraying tool, especially for spraying mold halves in a pressure casting machine. The spraying tool has spray nozzles fed with spraying agents and is fixed upon spray plates or spray bars which are assembled in a modular manner.

A spray head of this kind is disclosed in U.S. Pat. No. 4,760,961. The elements therein, equipped with spray nozzles, are assembled together column-wise in vertical or horizontal lines, and the media to be sprayed can be passed from element to element. These individual spray elements and also spacing parts inserted between them are held together by threaded bolts which are passed through openings in the elements. This method has the disadvantage that, for different sizes of the assembled spray elements or plates, different fasteners of various length have to be prepared. It is also disadvantageous that, in the case of a plurality of module-like elements arranged in a row, the threaded bolts or tie bolts have to be released and with them all the extensions that they hold together. Under certain circumstances, if an additional extension or reduction of elements not threaded on at the end is needed, but at the beginning, i.e., close to the distribution bar, all of the elements have to be taken off from the tie bolt. In this case dirt can enter at the points of separation.

EP 0 724 486 B1 discloses a spray bar on which plate-like elements are assembled. There too, however, the component parts are held together by threaded bolts or tie bolts of appropriate length.

An object of the invention is to design a spray bar such that a simple modular assembling of individual spray elements or connecting parts is possible without the need for fastening the parts together with threaded bolts or the like.

To achieve this and other objects, a spray head has coupling elements. The coupling elements have passages for the media to be sprayed, such as air, control means and spray media, are provided on the ends of the parts to be joined together, and are connected to the channels supplying the media. The coupling elements reach into the two chambers of the ends to be joined and are provided with hollow spaces with at least one sloping plane, which are engaged by clamping means which can be operated from the outside and force the parts tightly against one another.

By this configuration each element is provided on its connecting surfaces with connecting means which permit the elements to be released at any point, without the need to thread bolts or the like through holes.

In an advantageous configuration of the invention the coupling elements are provided at both face ends with sealing rings, so that they also provide the necessary seal between two elements which are to be assembled together.

The coupling elements can be made simply as cylindrical pins having two recesses each. The recesses are provided with planes sloping up toward one face surface. In this case the clamping means can be configured simply as screws with a conical tip which cooperate with the recesses.

In further development of the invention, pairs of chambers can be provided parallel to one another at each end of the component elements, and these chambers can be coaxial with the passages carrying control air and parting agents. Also at least one passage can be provided for drying air or compressed air between the passages provided for control air and parting agents.

The component elements can be provided with angled end portions for the connection of additional component elements or plates at an angle, and the end portions of attached corner pieces are formed in a simple configuration with angles of any kind, e.g., 45° or 90°. With this configuration there is also the possibility that component elements can be provided, for example, in bar or plate form turned away from one another at different directions and angles. Thus any desired spatial arrangement of spray elements is possible. To lengthen or shorten the spray bars or spray plates it is necessary only to separate them at the point at which the lengthening or shortening is to be made. All of the coupling elements in the entire spray head are in that case identical.

Other objects, advantages and novel features of the present invention will become apparent from the following detailed description of the invention when considered in conjunction with the accompanying drawings.

DETAILED DESCRIPTION OF THE DRAWINGS

Figure 1:
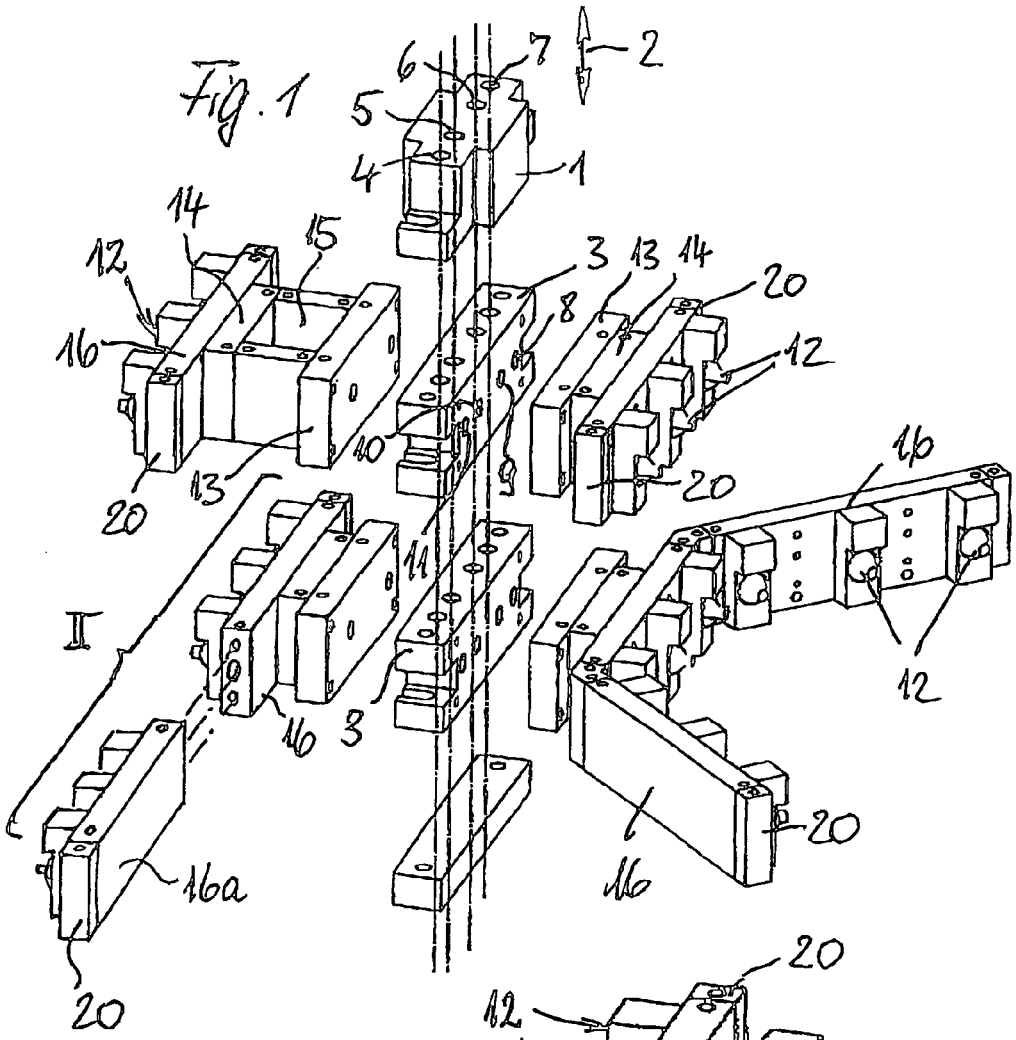
FIG. 1 is an exploded view of a spray head constructed according to the invention for spraying a mold.

The structure of a spray head according to the invention is shown schematically in FIG. 1. A portion 1 of an arm guided for motion in the direction of the arrow 2 is provided on its bottom with a plurality of distributor bars 3 in alignment with one another. The distributor bars 3 preferably are all of identical shape and arranged in the direction of movement 2. The distributor bars 3 are arranged close together with one another and tight against the joining end of the arm 1.

The arm 1, which in a known manner is connected with a controllable drive, has in its interior the schematically indicated passages 4, 5, 6 and 7, to feed parting agent, control aid and compressed air, which are controlled from the exterior. These passages 4 to 7 continue downwardly in each distributor bar 3, and supply passages branching off laterally from these passages 4 to 7 are provided. The supply passages open at points 8, 9, 10 and 11 on the sides of the distributor bars 3. From there the connection to spray nozzles 12 takes place through connecting plates 13 and flange bars 14, in some cases also with the spacers 15. Thus it becomes possible to arrange spray nozzles 12 in various ways, level by level, i.e., always in a horizontal plane of one of the distributor bars 3, in order to adapt the spray bar as well as possible to the interior shape of the movable mold halves and of the solid halves of the mold in a pressure casting machine. It is of course necessary after each casting procedure to blow out these mold halves with parting agent or also with compressed air.

Figure 2:
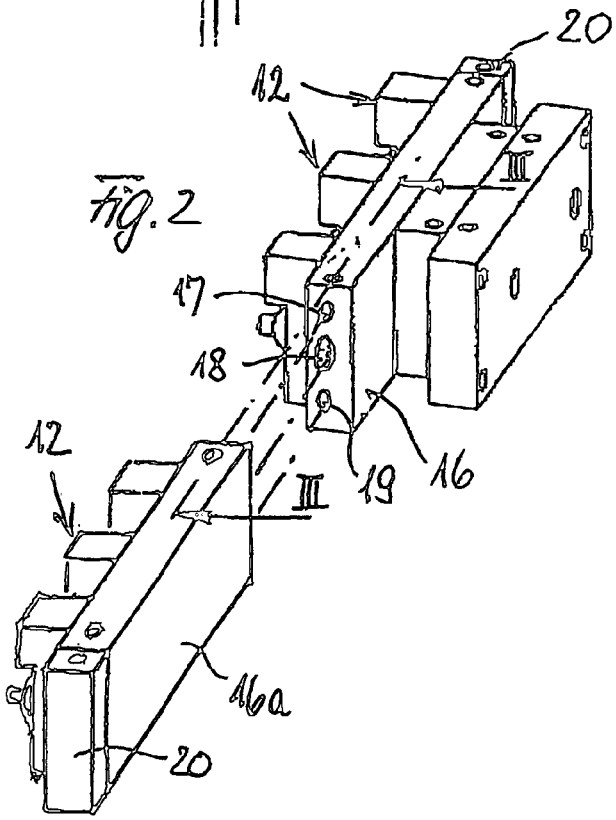
FIG. 2 is an enlarged representation of detail II of FIG. 1.

The spray nozzles 12, as especially seen in FIG. 2, are mounted on spray bars 16 and 16*a*, which are largely identical to one another. These spray bars 16 are provided in their interior with passages 17, 18 and 19, of which passage 18 serves, for example, to carry compressed air, passage 17 for feeding parting agent, and passage 19 for carrying operating air with which the spray nozzles 12 equipped with appropriate valves are opened at specific moments in time and can be closed again. These passages 17 to 19 are, as shown in FIG. 2, connected either with the through-passages of an adjacent spray bar 16*a* or, as indicated on the exteriors of the spray bars 16, are closed with a stopper 20.

Figure 3:
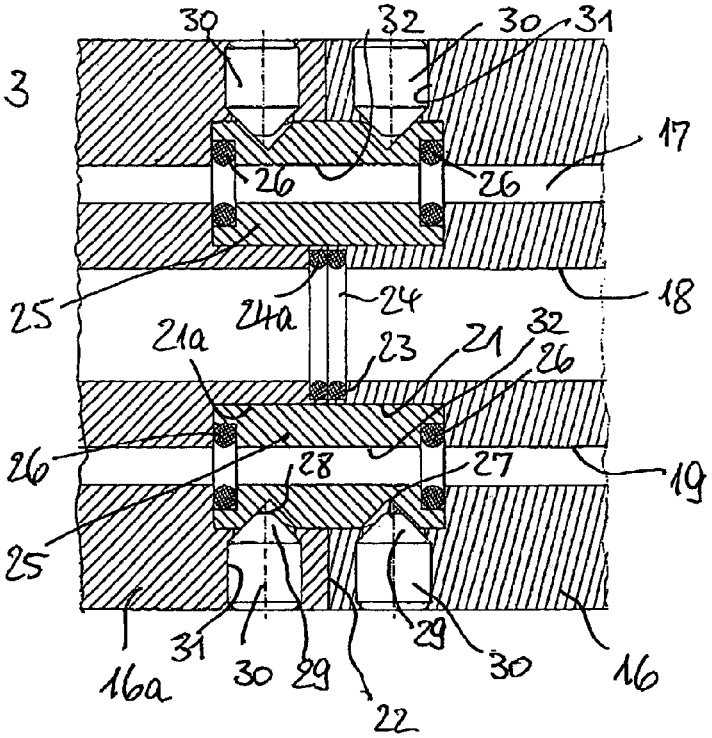
FIG. 3 is an enlarged representation of the section taken in the direction of plane III in FIG. 2.

FIG. 3 shows how the assembly of the ends of bars 16 and 16*a* is accomplished. Chambers 21 and 21*a* are provided in the end areas of bar 16 and bar 16*a* in line with the passages 17 and 19, and extend in both bars 16 and 16*a* to the end face 22 in contact with the adjacent element. The center passage 18 forms between the adjacent elements an annular groove 23 which is provided each with a sealing ring 24, 24*a*. These sealing rings therefore seal the passage 18 when the elements 16 and 16*a* are joined together.

To achieve this assembly in a simple manner, coupling elements 25 are inserted into the chambers 21 and 21*a*, which are cylindrical in the illustrated embodiment. Each coupling element 25 maybe a cylindrical pin which is provided at each of its ends with a sealing ring 26 arranged in an annular recess. The sealing ring 26 comes in contact with a counter-surface of the chamber 21 or 21*a* when the elements are assembled tightly together. The connecting element 25 also has two tapered surfaces 27 and 28, each ascending from the axis of the connecting element toward the ends of the connecting element 25. In the illustrated embodiment the tapered surfaces 27 and 28 are part of a tapering bore in the circumference of the connecting element 25. The conical apexes 29 of Allen screws 30 which can be screwed in from the exterior into matching threaded bores 31 cooperate with these tapered surfaces 27. When these elements 30 are screwed in, the bars 16 and 16*a* are forced with their ends 22 together, and in this process the packing rings 26 and 24 come into tight contact with their confronting surfaces. The bars 16 and 16*a* are therefore tightly coupled together. The coupling elements 25 are equipped each with a through passage 32 which is in line with the through passages 17 and 19, and has the same diameter as the said through passages 17 and 19. The coupling elements 25 therefore serve not only to urge the ends of adjacent bars 16 or 16*a* mechanically together but also to provide for the connection of the media passages in the parts to be coupled together.

Figure 4:
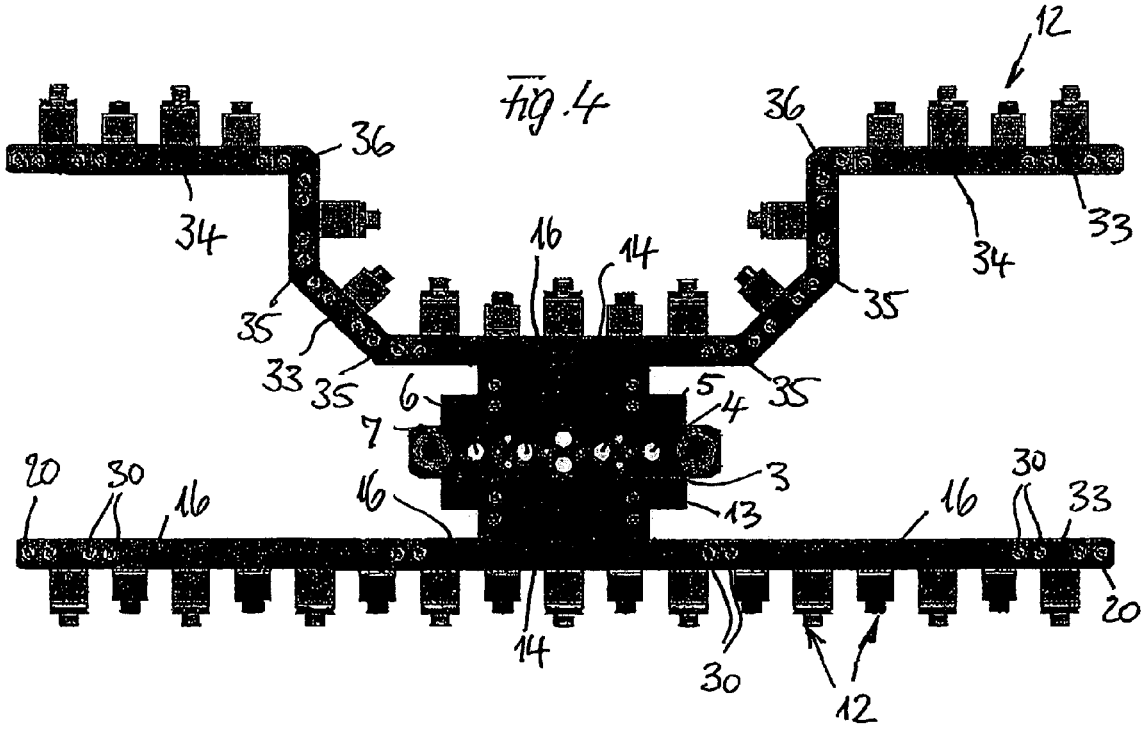
FIG. 4 is a top plan view taken in the direction of the movement of the spray head of FIG. 1 on a spray head partial plane constructed according to the invention, in a form not shown in FIG. 1.

FIG. 4 now shows that the spray elements in the form of bars of different lengths, for example, can be coupled together due to the configuration according to the invention. In the bottom part, bars are assembled together in line and are provided with spray nozzles 12. From the foregoing it becomes clear that the supply of media through these bars 16 is delivered through the passages 17, 18 and 19. At the outer end of each of these three bars 16 arranged in line with one another a spray element 33 with only one spray nozzle is attached and the passages running in this element are shut off at the end by a plug 20. Also this plug is installed in the manner explained in FIG. 3, the same as the element 33 is connected to the bar 16.

In the upper part of FIG. 4, spray bars 34 of slightly greater length are also provided, and partial spray elements 33 (with only one spray nozzle) are connected by angle pieces 35 or 36 to the middle spray bar 16 and to the elements 34. The angle piece 35 has an angle of 45° and angle 36 an angle of 90°. Also in these angle pieces passages 17, 18 and 19 run, and the corresponding chambers 21 are provided in order to insert the coupling elements 25.

The use of the novel coupling elements and the spray head formed thereby according to the invention permit the modular construction of spray heads from relatively few parts, which can be ideally adapted to the inside shape of the casting molds in a manner not known heretofore.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A spray head for a spraying tool, comprising:

a plurality of modular spray units, each spray unit having an end and a plurality of passages for the media to be sprayed, wherein the end of each spray unit has a chamber;

a plurality of coupling elements, each coupling element reaching into both chambers at the ends of first and second spray units that are to be joined by the coupling element, wherein each coupling element includes a passage which communicates with at least one of the passages of the first spray unit entering the corresponding chamber at the end of the first spray unit and with at least one of the passages of the second spray unit entering the corresponding chamber at the end of the second spray unit, and further includes a recess having a tapered surface; and a clamp that engages the tapered surface and presses the joined spray units together.

2. The spray head according to claim 1, wherein each coupling element has two ends and a sealing ring at each end.

3. The spray head according to claim 2, wherein the clamp includes a screw having a conical tip which cooperates with one of the recesses.

4. The spray head according to claim 1, wherein each coupling element has a cylindrical configuration and two recesses, each of which has a tapered surface.

5. The spray head according to claim 1, wherein the end of each spray unit has two chambers arranged parallel to one another.

6. The spray head according to claim 5, wherein the two chambers are coaxial with two of the passages of one of the spray units.

7. The spray head according to claim 6, wherein, between the two passages with which the two chambers are coaxial, the end of each spray unit includes a third passage.

8. The spray head according to claim 1, wherein at least one of the spray units comprises an angled piece adapted to connect to another spray unit.

9. A method of making a spray head for a spraying tool, the method comprising the acts of:

connecting first and second modular spray units end to end using one or more coupling elements, wherein each spray unit has an end and a plurality of passages for the media to be sprayed, wherein the end of each spray unit has a chamber, and wherein the coupling element reaches into both chambers at the ends of the first and second spray units to be joined, the coupling element including a passage which communicates with at least one of the passages of the first spray unit entering the corresponding chamber at the end of the first spray unit and with at least one of the passages of the second spray unit entering the corresponding chamber at the end of the second spray unit, and further wherein the coupling element includes a recess having a tapered surface; and joining the first and second spray units together using a clamp that engages the tapered surface of the coupling element.

* * * * *